US005664307A

United States Patent [19]

Stitz et al.

[11] Patent Number: 5,664,307

[45] Date of Patent: Sep. 9, 1997

[54] DRAW PROCESS

[75] Inventors: Albert Stitz, Kurten; Hans Peter Berger, Wermelskirchen; Ulrich Enders, Wuppertal, all of Germany

[73] Assignee: Barmag AG, Remscheid, Germany

[21] Appl. No.: 411,703

[22] PCT Filed: Apr. 26, 1994

[86] PCT No.: PCT/EP94/01315

§ 371 Date: Jul. 31, 1995

§ 102(e) Date: Jul. 31, 1995

[87] PCT Pub. No.: WO94/25653

PCT Pub. Date: Nov. 10, 1994

[30] Foreign Application Priority Data

Apr. 30, 1993 [DE] Germany ..... 43 14 226.5
Jul. 21, 1993 [DE] Germany ..... 43 24 448.3

[51] Int. Cl.[6] ..... D01D 5/12; D01D 5/16; G01L 5/04; G05D 23/00

[52] U.S. Cl. ..... 28/241

[58] Field of Search ..... 28/241, 240, 247, 28/248

[56] References Cited

U.S. PATENT DOCUMENTS

| | | | |
|---|---|---|---|
| 2,617,007 | 11/1952 | Atkins . | |
| 2,930,102 | 3/1960 | Hitchin et al. | 28/241 |
| 3,211,893 | 10/1965 | Barlow et al. | 28/241 X |
| 3,395,200 | 7/1968 | Mader, Jr. et al. . | |
| 3,509,595 | 5/1970 | Mader, Jr. et al. | 28/241 X |
| 4,404,718 | 9/1983 | Tajiri et al. | 28/241 X |
| 4,608,736 | 9/1986 | Tajiri et al. | 28/241 X |
| 4,902,461 | 2/1990 | Schippers . | |

FOREIGN PATENT DOCUMENTS

| | | | |
|---|---|---|---|
| 1 660 333 | 12/1970 | Germany . | |
| 22 04 535 | 6/1976 | Germany . | |
| 38 08 854 | 9/1988 | Germany . | |
| 33 46 677 | 5/1991 | Germany . | |
| 43 00 633 | 7/1993 | Germany . | |
| 93 06 510 | 7/1993 | Germany . | |
| 46-6535 | 2/1971 | Japan | 28/241 |
| 540108 | 10/1941 | United Kingdom | 28/241 |

OTHER PUBLICATIONS

Patent Abstracts of Japan, Publication No. JP5117929, Publication Date Feb. 9, 1993; Applicant: Murata Mach Ltd; Inventor: Matsui Isamu; Title: Cooling Plate For Draw–False Twister (JP5,117,929 pub. date May 1993).

*Primary Examiner*—John J. Calvert
*Attorney, Agent, or Firm*—Bell, Seltzer, Park & Gibson, P.A.

[57] ABSTRACT

A draw process is described, in which yarns in particular of thermoplastic plastics are drawn by influencing their temperature, so as to improve the yarn properties. The process can be employed in a spin process or in a subsequent improvement step. In accordance with the invention, the temperature of the temperature modulating device is controlled as a function of a yarn tension signal, which is obtained within or downstream of the draw zone.

17 Claims, 3 Drawing Sheets

DRAW PROCESS

BACKGROUND OF THE INVENTION

This invention relates to a method of drawing yarns in a draw zone which is equipped with a tempering device for influencing the temperature of the yarn, and an apparatus for drawing a yarn advancing through a draw zone with a tempering device for influencing the yarn temperature.

Such a method or such an apparatus are known, for example, from DE-OS 38 08 854, as well as from DE-PS 33 46 677, and DE-AS 22 04 535. In the known draw systems, the yarn is drawn by pulling it off the spinneret at very high withdrawal speeds and/or by the speed difference of two interposed draw rolls, and in each case it is heated in the draw zone. This invention is, however, not limited to such methods, but is suitable for all draw systems, which are equipped with tempering devices for influencing the yarn temperature.

In the art, there exists a factor of uncertainty in keeping the process parameters and the produced yarn properties constant in time, namely, in that the heat transfer between the yarn and the tempering device for influencing the yarn temperature, for example, a heated draw roll, heated tube, or cooling device (see, for example German Utility Model 9306510) does not remain constant, but changes in the course of time. Such unintended changes in the heat transfer cannot be detected, since in a continuous operation it is not possible to accurately measure the yarn temperature from the viewpoint of the measuring technology, whereas the temperature of the device for influencing the yarn temperature (hereafter described as tempering device or temperature modulating device) is controllable, though, but fails to be indicative of the actual heat exchange. Such variations in the exchange of heat, may originate, for example, from contaminations or wear or other operational, but unforeseen changes.

It is the object of this invention to describe a method and an apparatus, which allow the detect and eliminate unforeseen variations in the heat exchange between the tempering device and the yarn or their consequences.

SUMMARY OF THE INVENTION

The above and other objects and advantages of the present invention are achieved by the provision of a method and apparatus for processing an advancing yarn which includes the steps of advancing the yarn along a path of travel, applying a drawing force to the advancing yarn in a draw zone located along the path of travel and so as to draw the advancing yarn, and monitoring the tension of the advancing yarn at a location along the path of travel downstream of the draw zone and producing a control signal which is representative of the monitored tension. Further, the temperature of the advancing yarn is modulated so that the temperature of the yarn is controlled as a function of the control signal.

In accordance with the invention, the method of drawing yarns in a draw zone equipped with a tempering device for influencing the temperature of the yarn is characterized in that the yarn temperature influencing effect of the tempering device on the yarn is controlled as a function of a control signal, which is derived from the yarn tensile force (yarn tension) that is continuously measured at a measuring point within or downstream of the draw zone, the measuring point being selected such that the yarn speed remains substantially constant between the heating system and the measuring point. The formation of a difference between the actual value of the yarn tension and an predeterminable desired value is a further development, which has the advantage that from the viewpoint of process engineering an optimal input of the yarn tension is initially possible, and that only the variations from this input are detected and converted for adjusting the temperature of the tempering device, i.e., the heating or the cooling system.

The invention relates likewise to an apparatus for drawing a yarn advancing through a draw zone, which is provided with a tempering device for influencing the yarn temperature, and especially suitable for carrying out the method of the present invention. This apparatus comprises, in the draw zone or downstream thereof, a device for measuring continuously or at intervals the yarn tension, and an electronic evaluation unit for converting found variations of the tension into correcting signals, which is connected via a signal line with the device for measuring the yarn tension and, furthermore, with a temperature control of the tempering device.

The tempering device may be a heating device, with the device for measuring the yarn tension being connected via the signal line and the electronic evaluation unit with the device for controlling the temperature of the heating device. The preparation of measuring signals and the generation of correcting signals as a function of the variation of a measured actual value from a predetermined desired value may naturally be integrated already in the device for measuring the yarn tension with the further processing occurring then in the electronic evaluation unit.

In a draw system having a heated draw roll or godet and arrangements for influencing or controlling the godet temperature, the device for measuring the yarn tension is located, for example, downstream of the draw roll forming the end of the draw zone. It transmits the measured actual values or correcting values derived therefrom, via a signal line and an electronic evaluation unit for influencing the godet temperature, to a device for the control thereof.

For purposes of influencing, as a function of the yarn tension, the signals supplied by a central control unit for the godet heating, the actual value signals or signals derived therefrom may be supplied, for example, to one of the correcting value generators which follow the central control unit. In so doing, it has shown to be favorable for stabilizing the yarn tension, when the heated draw roll is preceded by a predraw godet. Advantageously, also the predraw godet is heated. In particular, with the use of an—unheated or heated—predraw godet, it is possible to arrange the device for measuring the yarn tension also between the two godets.

The method of the present invention may be employed in all draw systems, in which the temperature of the yarn advancing through the draw zone is influenced, aside from the aforesaid heated godet, by a heating device, such as, for example, a heating tube of any design, a hot plate, a heating chamber, or also by a cooling device.

Thus, in a special further development of the invention, the device for influencing the yarn temperature comprises, for example, a cooling tube as a cooling device with a controllable cooling effect, and with its wall being provided with air supply openings, which are associated with at least one adjustable throttle or shutter for controlling the air quantity and, thus, the cooling effect. The signals, which are in this embodiment supplied by the device for measuring the yarn tension arranged downstream of the cooling device, serve to adjust the throttle(s) or shutter(s).

The invention is based on the recognition, as has been verified by extensive tests, that the progression of the heat transfer influences the yarn tension very considerably, it being possible to measure the yarn tension upstream or downstream of the tempering device. When the yarn tension is measured upstream of the tempering device, it will be necessary that the measuring occur in the draw zone, in which also the tempering device is arranged. When the yarn tension is measured downstream of the tempering device, the measuring may again occur directly below the tempering device, but also with a godet interposed. It has shown that even in subsequent processing zones, for example, in the takeup zone, the adjusted level of the yarn tension will undergo a change, when the heat transfer varies (see, not yet published German Application P 43 00 633.7). However, it is necessary that the yarn speed be substantially constant from the end of the tempering device to the measuring point of the yarn tension, i.e., there must be a defined advance of the yarn between the tempering device and the measuring point, so that the yarn tension cannot be changed by additional influences.

In this instance, one may proceed in such a manner that the actual values of the yarn tension measured at the measuring point are compared with a predeterminable (possibly time-dependent) desired value, with correcting signals for controlling the godet temperature being determined from the variations of the actual values of the yarn tension from the desired value. Basis for a (time-dependent or constant) desired value to be predetermined may be, for example, empirical values, such as are obtained from an evaluation of recorded production data, or the mean value of such empirical values. When processing the registered variations of the tension from the desired value, it will be advantageous to consider a tolerance range, which may likewise be established based on empirical values.

The measuring signals originating from the variations in the yarn tension and converted into correcting signals allow to modify, in accordance with the invention, the temperature of the tempering device, which is predetermined by a central control unit, so that the yarn tension does not leave a tolerance range which has been predetermined for the chronological progression of the yarn tension.

BRIEF DESCRIPTION OF THE DRAWING

Referring now to embodiments of the apparatus of the present invention as illustrated in the drawing, the invention is described in more detail.

In the drawing.

DETAILED DESCRIPTION OF THE PREFERRED EMBODIMENTS

Figure 1:
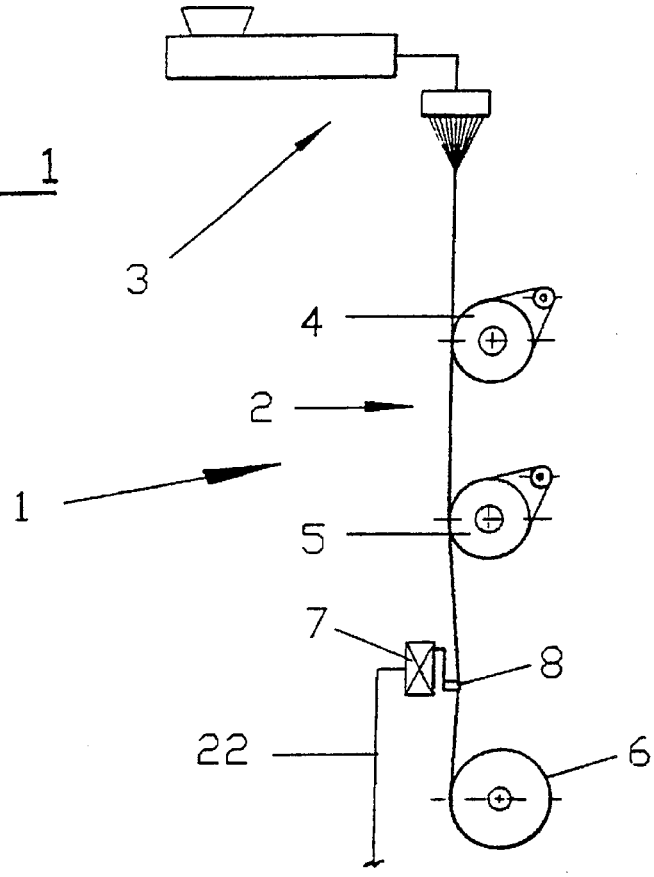
FIG. 1 is a schematic view of a spin draw system with a draw zone between two godets and the device for measuring the yarn tension downstream of the second godet.

Schematically illustrated in FIG. 1 is a draw system 1 represented only by a spin system 3, a draw zone 2 defined by two godets 4 and 5, and a takeup 6. Arranged between draw roll or godet 5 and takeup 6 forming the outlet end of draw zone 2 is a device 7 for measuring the yarn tension, for example, a yarn tension sensor 8 equipped with an inline yarn tension measuring head as described in the not yet published German Application P 43 00 633.7. This device 7, 8 for measuring the yarn tension is connected via a signal line 22 with an electronic evaluation unit 11, in which the yarn tension fluctuations measured by device 7 for detecting the yarn tension are compared with desired values and converted into correcting values, and supplied to the signals originating from a central control unit 10.

Figure 1A:
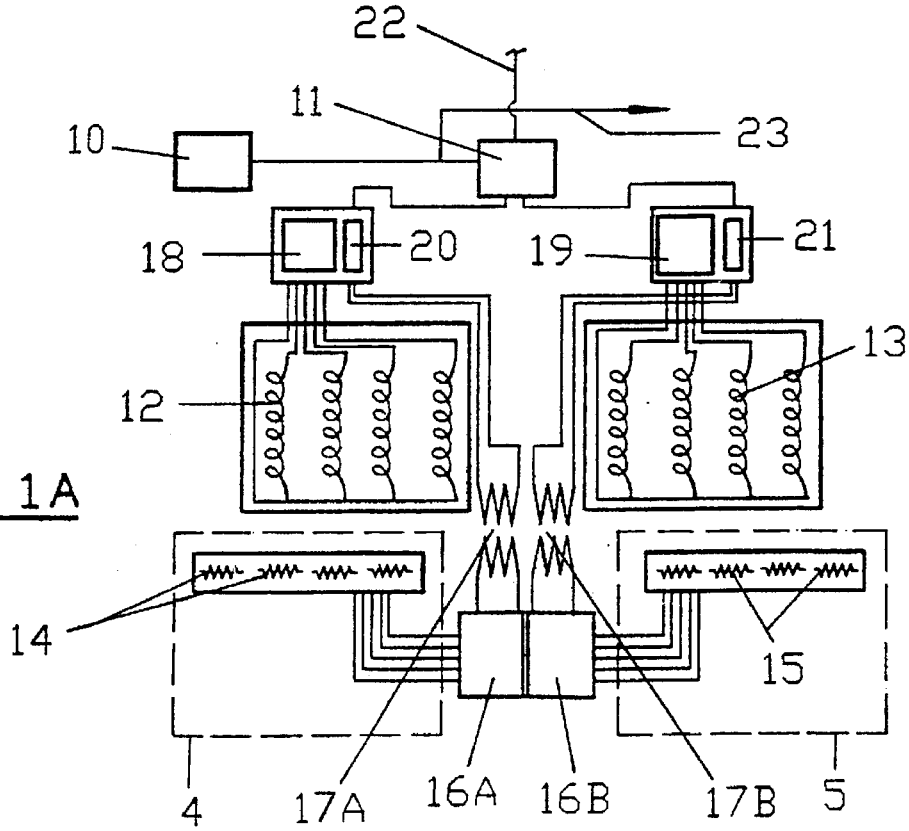
FIG. 1A is a diagram of the heating control system for the two godets shown in FIG. 1.

FIG. 1A is a schematic view of a godet heating system with a temperature control for the two godets 4 and 5. The uniform control signals which are generated in central control unit 10, for example, for all processing positions 1 of a machine, of which only one is shown, advance via a line 23 to the electronic evaluation unit 11 associated to each draw system, in which these signals receive the correction signals. The thus modified signals are input in the temperature, control units 20 and 21 associated to the two godets 4 and 5 with heaters 12 and 13.

The temperature values which are generated by temperature sensors 14, 15 arranged in godets 4, 5 are converted, for example digitized, into signals measuring converters 16A, 16B, and advance via measuring transformers 17A, 17B likewise to temperature control units 20, 21, which allow to define—based on both the signals originating from the correcting value generator and the actual value signals—the amount of the energy supply to the godet heating system, which is effected by two HF supplies 18, 19 associated to heaters 12, 13.

In this manner, the basic adjustment serving to predetermine a constant godet temperature is modified such that changes in the yarn temperatures leading to fluctuations in the yarn tension are corrected.

FIGS. 2 to 6 illustrate further embodiments of the draw system in accordance with the invention.

Figure 2:
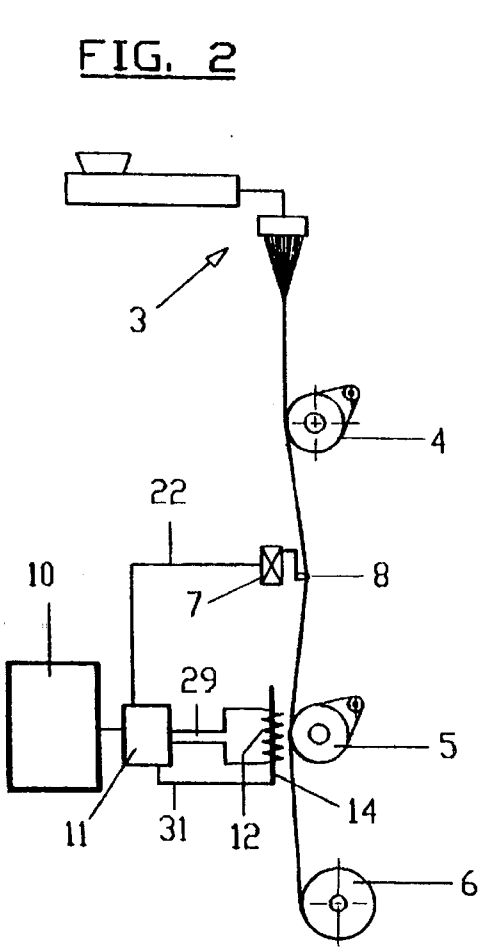
FIG. 2 is a schematic view of a spin draw system as in FIG. 1, however, with the device for measuring the yarn tension being arranged in the draw zone.

Thus, the subject matter of FIG. 2 is a draw system, which differs from that shown in FIG. 1 in that the device 7 for detecting the yarn tension is provided between the two godets 4 and 5, of which the second one can be heated, and that the yarn tension fluctuations are measured within draw zone 2.

Figure 3:
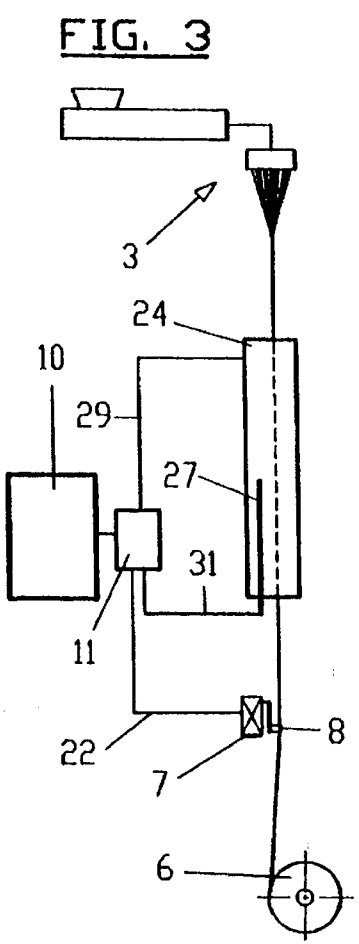
FIG. 3 is a schematic view of a spin draw system without godets and with a tubular heater and the device for measuring the yarn tension being arranged downstream of the tubular heater.

FIG. 3 illustrates an embodiment of a spin draw system in accordance with the invention without godets. Between spin system 3 and takeup 6, the yarn passes through a tubular heater 24. The device 7, 8 for measuring the yarn tension is provided between tubular heater 24 and takeup 6. The signals generated by same from the fluctuations in the yarn tension advance via signal line 22, and the temperature signals generated by a temperature sensor 27 arranged in tubular heater 24 advance via a signal line 31 to electronic evaluation unit 11, where the desired values predetermined by central control unit 10 and, thus, energy supply 29 of the tubular heater are modified as a function of the actual value signals originating from the measuring of the yarn tension and the measuring of the temperature. If, as a further development, a godet is provided between the end of tubular heater 24 and takeup 6, it will be possible to arrange the device 7, 8 for detecting the yarn tension between tubular heater 24 and the godet (not shown), or between the latter and takeup 6.

As a tubular heater 24 such may be used which has a fixed length and controls the heating effect on the yarn by changing the temperature in the interior of tubular heater 24. It is also possible to use a tubular heater 24 with an inside temperature which is kept constant, and in which the change of the heating effect on the yarn necessary to correct the yarn tension fluctuations occurs as a result of changing the length of the heating tube. Accordingly, it is then possible to use the correcting signals, which originate from measuring the yarn tension, which advance via signal line 22 to electronic evaluation unit 11, and which are then further transmitted to change the length of the tubular heater as a function of the yarn tension.

Figure 4:
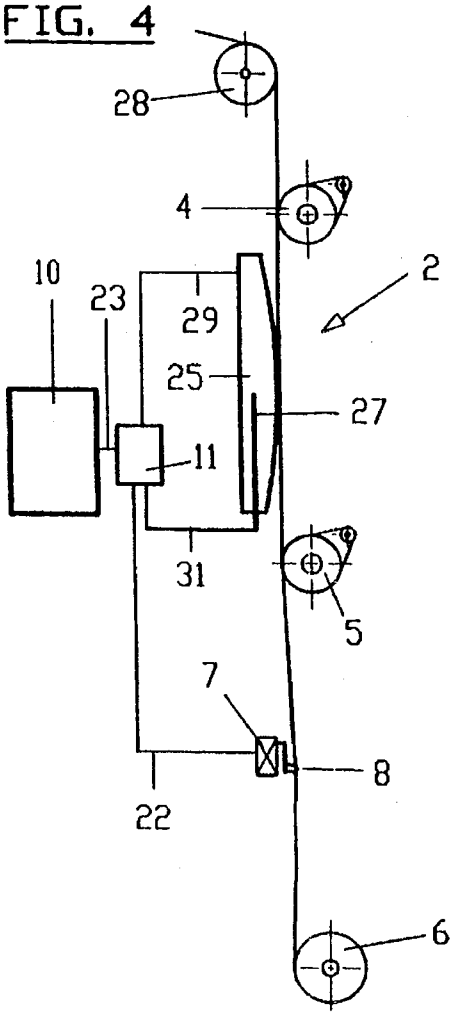
FIG. 4 shows a draw system with hot a plate.

A further embodiment of the draw system in accordance with the invention is shown in FIG. 4. The possibly partially oriented yarn is supplied over a deflection roll 28, and advances over a first godet 4 into draw zone 2, where is heated by being guided over a hot plate 25. It is then withdrawn by draw roll 5 and after passing through device 7, 8 for measuring the yarn tension, and after converting the measured tension variations into correcting signals, it reaches takeup 6. The signals generated by device 7, 8 advance via signal lines 22 to electronic evaluation unit 11, where they are used, together with the correcting signals originating from temperature monitor 27, for the correction of the desired value signals originating from central control unit 10 and, thus, for the energy supply via a schematically indicated connecting line 29.

Figure 5:
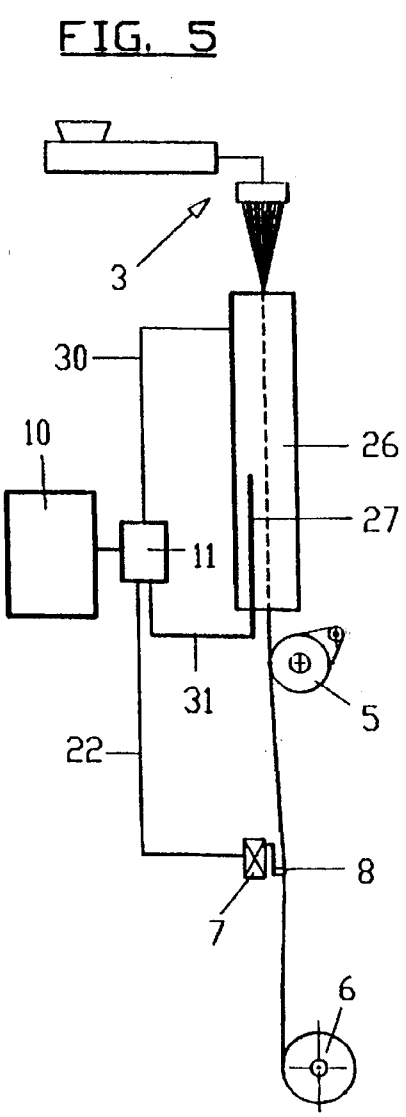
FIG. 5 shows a spin draw system with a controlled cooling shaft and delivery godet as well as a device for measuring the yarn tension downstream of the godet.

Finally, shown in FIG. 5 is a schematic view of a spin draw system equipped in accordance with the invention, which differs from the foregoing embodiments in that the device for influencing the yarn temperature is a cooling device 26 (air flow) with a controllable cooling effect, which is arranged substantially subjacent spin system 3 and monitored by a temperature sensor 27. The device 7, 8 for measuring the yarn tension is arranged downstream of the cooling device and connected via a signal line 22 and an electronic evaluation unit 11 with the device for controlling the cooling effect of cooling device 26.

In the illustrated embodiment, the cooling device is a cooling tube 26 with air supply openings provided in its wall. Associated to the latter is at least one adjustable throttle or shutter. Accordingly, the signals originating from device 7, 8 for measuring the yarn tension are transmitted via a signal line 22, to a device not shown for adjusting possibly several throttles or shutters via a control line 30, the device being controlled via electronic evaluation unit 11.

It should further be noted that the bundle of filaments shown in the drawing of FIG. 5, must be cooled before being combined to a yarn to such an extent that the filaments do no longer stick to one another, i.e., a yarn guide causing them to combine is arranged preferably in or at the outlet end of cooling shaft 26.

Figure 6:
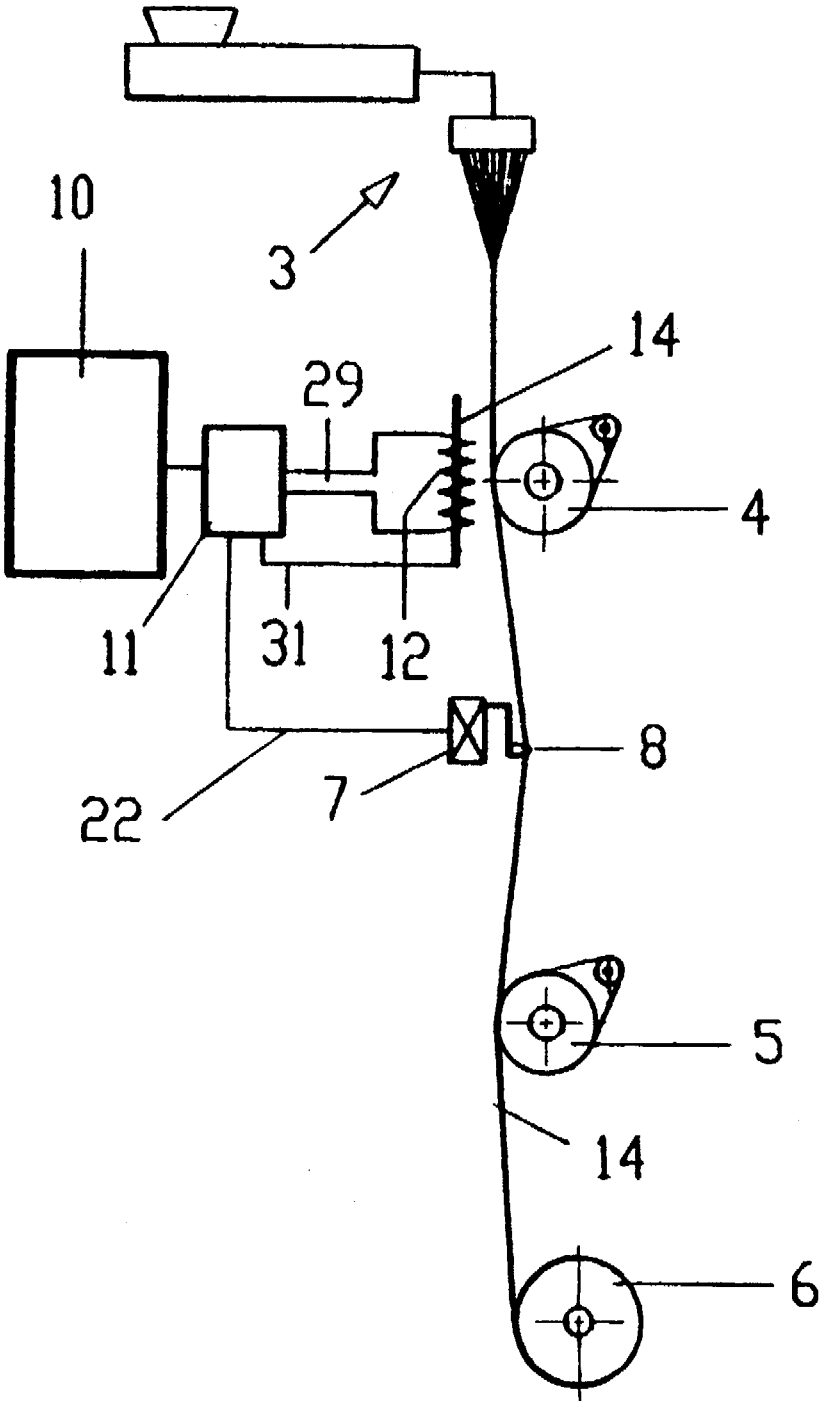
FIG. 6 is a schematic view of a spin draw system as in FIG. 2, however with a heated godet upstream of the draw zone.

Shown in FIG. 6 is yet another embodiment of a draw system 1 similar to that of FIG. 2. Here again, the device 7 for detecting the yarn tension is provided between the two godets 4 and 5, and the yarn tension fluctuations are measured within draw zone 2. In this embodiment the first godet 4 is heated.

The invention has been described with reference to draw and spin draw systems illustrated in the attached drawing. It is however not limited to the illustrated and described embodiments, but can be used with success in all draw systems equipped with a device for influencing the yarn temperature for purposes of improving the quality of drawn products.

We claim:

1. A method of processing an advancing yarn comprising the steps of advancing the yarn along a path of travel, applying a drawing force to the advancing yarn in a draw zone located along the path of travel and so as to draw the advancing yarn, monitoring the tension of the advancing yarn at a location along the path of travel downstream of the draw zone and producing a control signal which is representative of the monitored tension, and modulating the temperature of the advancing yarn so that the temperature of the advancing yarn is controlled as a function of the control signal.

2. The method as defined in claim 1 wherein the control signal represents the difference between the actual yarn tension and a predetermined desired value of the yarn tension.

3. The method as defined in claim 2 wherein the predetermined desired value comprises a mean value of the actual values of the yarn tension measured over a period of time.

4. The method as defined in claim 1 wherein the temperature modulating step includes applying heat to the advancing yarn so as to modulate the temperature of the advancing yarn as it passes through the draw zone.

5. The method as defined in claim 1 wherein the temperature modulating step includes cooling the advancing yarn so as to modulate the temperature of the advancing yarn as it passes through the draw zone.

6. The method as defined in claim 1 comprising the further step of maintaining the advancing yarn at a defined speed between the point at which the temperature is modulated and the point at which the tension is monitored.

7. An apparatus for processing an advancing yarn comprising means for advancing the yarn along a path of travel, means for applying a drawing force to the advancing yarn in a draw zone located along the path of travel and so as to draw the advancing yarn, a yarn tension measuring device positioned at a location downstream of the draw zone and for producing a control signal which is representative of the monitored tension, and a yarn temperature modulating device positioned at a location along the path of travel so that the temperature of the advancing yarn passing through the draw zone is controlled as a function of the control signal.

8. The apparatus as defined in claim 7 wherein the means for applying a drawing force to the advancing yarn comprises a pair of spaced apart draw rolls which define the draw zone therebetween.

9. The apparatus as defined in claim 8 wherein the yarn temperature modulating device includes means for heating at least one of said draw rolls.

10. The apparatus as defined in claim 7 wherein the temperature modulating device comprises a yarn heater positioned adjacent the draw zone.

11. The apparatus as defined in claim 10 wherein the yarn heater comprises a tubular member through which the yarn advances.

12. The apparatus as defined in claim 11 wherein the tubular member of the yarn heater has a variable length, so that the heating effect on the yarn is changed by changing the length of the tubular member.

13. The apparatus as defined in claim 10 wherein the yarn heater comprises an elongate plate positioned so that the yarn advances along the length thereof.

14. The apparatus as defined in claim 10 wherein the temperature modulating device further comprises an evaluation unit which is programmed to convert the variations between the actual yarn tension and a predetermined desired value of the yarn tension into a corrective signal which acts to control the heating effect of said yarn heater.

15. The apparatus as defined in claim 7 wherein the yarn temperature modulating device includes means positioned adjacent the draw zone for cooling the advancing yarn with an adjustable cooling effect.

16. The apparatus as defined in claim 15 wherein the cooling means comprises a tubular member having air supply openings in the periphery thereof, and throttle means for adjusting the size of the air supply openings.

17. The apparatus as defined in claim 15 wherein the temperature modulating device further comprises an evaluation unit which is programmed to convert variations between the actual yarn tension and a predetermined desired value of the yarn tension into a corrective signal which acts to control the cooling effect of said yarn cooling means.

* * * * *